United States Patent [19]

Luth

[11] 4,127,259

[45] Nov. 28, 1978

[54] APPARATUS FOR CONTROLLING THE INJECTION OF OIL INTO A BLAST FURNACE

[76] Inventor: Friedrich A. K. Lüth, Leugplatz 3, 4 Düsseldorf-Oberkassel, Fed. Rep. of Germany

[21] Appl. No.: 800,519

[22] Filed: May 25, 1977

Related U.S. Application Data

[62] Division of Ser. No. 512,152, Oct. 4, 1974, Pat. No. 4,040,817.

[30] Foreign Application Priority Data

Oct. 4, 1973 [DE] Fed. Rep. of Germany ..... 2349930

[51] Int. Cl.[2] ..... C21B 7/16; F27B 1/16; F27B 1/26

[52] U.S. Cl. ..... 266/83

[58] Field of Search ..... 75/41, 42; 266/80–83

[56] References Cited

U.S. PATENT DOCUMENTS

| | | | |
|---|---|---|---|
| 3,343,826 | 9/1967 | Manny et al. | 266/83 |
| 3,346,249 | 10/1967 | Manny | 266/82 |
| 3,833,356 | 9/1974 | Luth | 75/41 |
| 3,856,509 | 12/1974 | Heynert et al. | 75/42 |

*Primary Examiner*—Roy Lake
*Assistant Examiner*—Paul A. Bell
*Attorney, Agent, or Firm*—Holman & Stern

[57] ABSTRACT

An instrument for measuring the blast air volume within a blast tuyere is connected to a ratio controller which controls the opening and closing of oil and water valves in proportion to one another. A servomotor connects the ratio controller to the oil and water valves attached to a common shaft. The servomotor and the ratio controller are fed back to each other by a set value/actual value comparison. A differential pressure obtained by the blast air measuring instrument can be converted by transducers into a differential voltage and a differential current which controls the ratio controller.

5 Claims, 4 Drawing Figures

APPARATUS FOR CONTROLLING THE INJECTION OF OIL INTO A BLAST FURNACE

This is a divisional of application Ser. No. 512,152, filed Oct. 4, 1974 which in turn is now U.S. Pat. No. 4040817.

BACKGROUND OF THE INVENTION

The present invention relates to an apparatus for controlling the injection of oil into a shaft furnace. When reducing iron ores into pig iron in a shaft furnace, especially a blast furnace, wherein coke and oil (e.g. fuel oil) are used as the reducing agents and the oil is added through at least one pipe having a nozzle head to the blast furnace blast air heated to a high temperature and being blown into the blast furnace via a blast tuyere, said pipe and said nozzle head, at least in portions thereof, are subjected to the high temperature of the blast air supplied to the blast furnace.

When injecting oil or fuel oil through the blast tuyeres of a blast furnace, substantial difficulties due to variations of the blast air pressure and of the blast temperature may result from the fact that these parameters substantially affect the blast air velocities within the blast tuyere and also the viscosity of the blast air or flue gas.

It has been found that variations of the blast velocity have a noticeable effect on the optimum distribution and combustion of the injected volume of the oil. Such variations of the blast velocity occur primarily in the case of failure and, for instance, in connection with the change-over of the hot blast stoves of regenerators.

In order to avoid uncomplete oil combustion within the blast tuyere and, therefore, to avoid damage of the latter, it has already been considered to automatically stop the oil supply at the respective oil injection nozzle when a minimum value of the hot blast throughput is reached; however, great difficulties have been reported in these respects (compare Klepzig: "Fachberichte", July 1969, page 477).

Actually, in the conventional apparatus there does not so much exist the difficulty of burning out of the blast tuyere; rather, due to the ON-OFF control associated therewith, the disadvantage of very substantial variations of the volume of oil supplied exists, which disadvantage in the coal-oil balance of a blast furnace becomes apparent in a deciding manner with respect to the freedom from trouble in the furnace operation of furnace working especially when the proportion of the oil is high, i.e. between 100 and 200 kg of oil per (metric) ton of pig iron, with a coke proportion which is thus reduced to from 500 to 400 kg per ton of pig iron. If the known minimum switch-over value of the oil supply is too high, the oil supply is stopped two frequently; if, on the other hand, this value is too low, there are frequent intervals with too high a quantity of oil, i.e. with uneconomical operation and black smoke formation in the furnace.

Primarily, however, simple switching on and off raises problems with respect to the cooling of the oil lance.

SUMMARY OF THE INVENTION

It is the object of the present invention to avoid in an economical and structurally simple manner these different disadvantages of conventional apparatuses for the oil injection.

To this end, in an apparatus of the kind as outlined above, the invention permits continuous control of the ratio of the added volume of oil relative to the introduced volume of blast air in response of the respectively existing value of the volume of blast air, defined e.g. as a differential pressure volume measurement, and, when the injected oil volume is reduced to below a predetermined minimum volume, the addition or admixture, in a controlled manner, to the oil prior to its entry into the thermally stressed portion of the pipe, a liquid coolant, e.g. water, for the cooling of said pipe in such a manner that the total amount of the oil and of the coolant even in the case of a further reduction of the volume of the oil added ensures a cooling effect which safely prevents clogging of said pipe by setting or stopping of the flow of the oil due to temperature influence.

In a specific method and apparatus (German Pat. No. 2,051,676) for the oil injection into a blast furnace wherein the oil is injected into the blast air flow through a single pipe including a nozzle head positioned on the axis of the blast tuyere, in radially outward direction in the form of injection jets at such an oulet velocity at which the oil is distributed within the blast air flow to a point closely adjacent the inner wall of the blast tuyere, such ON-OFF control of the oil supply is not possible at all. That is, this method requires a relatively sensitive control of the radial extent of the injection jets up to a point closely adjacent the inner wall of the blast tuyere. The injection jets must be prevented in the case of a temporary reduction of the blast air volume or velocity, from contacting the inner wall of the blast tuyere because this would result in absolutely harmful oil-coke deposits within the cross-sectional flow area of the blast air and, inter alia, would rapidly destroy the blast tuyere. Similarly, the injected oil must not be distributed only to a point which is not very close to the inner wall of the blast tuyere because the volume of the oil added in this specific method is at least twice that of the conventional methods, such that an insufficient distribution across the cross-sectional area of the blast tuyere would result in more than normal black smoke generation with correspondingly high economical losses. Accordingly, variations of the blast air quantity are particularly detrimental in the existing method. Add to this the fact that, in view of the high thermal stresses to which a nozzle head positioned centrally within the high temperature blast air flow is subjected, an even momentary stopping of the oil supply would destroy the oil lance.

Therefore, in a preferred embodiment the invention aims at an improvement of the above-described apparatus, which improvement permits continuous control of the ratio between the oil volume added and the introduced volume of the blast air in dependency of the respectively existing value of the volume of the blast air (e.g. differential pressure volume measurement) in such a manner that the injected oil is kept spaced from the inner wall of said blast tuyere, which spacing corresponds approximately to the spacing at the full rated volume of the blast air, and wherein, when the oil volume falls below a predetermined minimum oil volume, the addition or admixture to the oil prior to its entry into said pipe, in a controlled manner, a liquid coolant, e.g. water, for cooling said pipe and said nozzle head in such a way that the sum of the oil and the coolant then provides a cooling effect even if the added volume of the oil is further reduced, which cooling effect safely prevents clogging of said pipe and of said nozzle head by setting or stopping of the flow of the oil due to temperature influence, even in the case of a further reduction of the volume of the oil added.

Consequently, with the apparatus according to the invention it is not only possible to obtain, in a constructionally most simple manner, an improvement of the furnace operation and a utilization of the reduction effect of the oil which is more favorable even during varying phases (intervals) of the blast air, but also better performance of the blast furnace and an improvement of the quality of the slag. Rather, according to the invention, in the first line there is rendered possible a full and trouble-free utilization of those blast furnace methods which operate with substantially increased quantities of added oil.

A very important feature of the invention resides in the fact that each blast tuyere is controlled individually, whereby in particular a high sensitivity of response of the control according to the invention must be provided.

According to the invention, it is of equal importance that the addition of said coolant to the oil is started at a reduction of the oil volume to from about 40 to 60% (vol.%), preferably about 50% (vol.%), of the oil supply at the full rated volume of the blast air.

A further essential feature of the invention consists in that in the case of a complete stop of the oil supply, the coolant (water) only is injected through said pipe and said nozzle head, and that in a quantity of less than about 10% (vol.%) of the volume of the oil added at full rated volume of the blast air, whereby the water or coolant volume is less than 3% of the oil volume added at full rated volume of the blast air.

According to the invention, extra security is provided if a ratio control is used which is controlled by a set value/actual value control of the ratio of the volume of the blast air to the oil volume and the oil volume to the coolant volume.

The present invention provides an apparatus characterized by a blast air volume measuring instrument positioned in each individual blast tuyere, and especially in the conduit of the latter, with the — preferably electrical — pulse of said measuring instrument, optionally after a conversion of the differential pressure into a differential voltage and a differential current, connected to a ratio controller — ratio of oil/blast air volume — for controlling a servomotor which controls or sets on a common shaft therof a water valve and an oil valve for connection to a common conduit, whereby said water valve opens only at a value of from about 40% to 50% (vol.%), preferably about 50% (vol.%) of the full rated volume of the fuel oil value, whereupon both valves open or close, respectively, in proportion with each other.

Additionally, the sensitivity of response of the apparatus to be improved is taken into account in that said servomotor and said ratio controller are fed back to each other by a set value/actual value comparison.

BRIEF DESCRIPTION OF THE DRAWINGS

In the following, the present invention is explained in greater detail in connection with several embodiments by referring to the accompanying drawings, wherein.

DETAILED DESCRIPTION OF THE PREFERRED EMBODIMENTS

Figure 1:
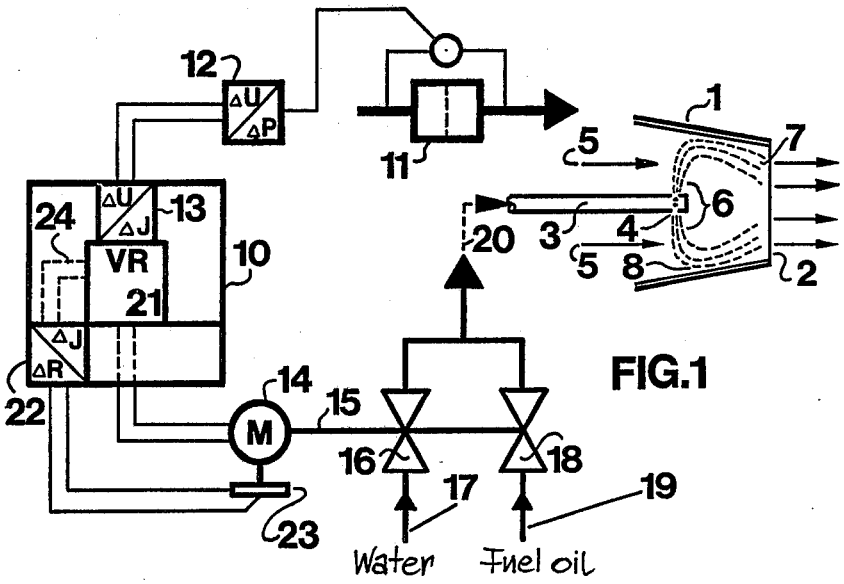
FIG. 1 is a schematical presentation of the control device according to the invention and of a blast tuyere of a blast furnace to which such device is installed.

A blast tuyere 1 shown in FIG. 1 is provided with a tubular oil supply lance 3 which is disposed approximately on the longitudinal axis of the blast tuyere and which has a nozzle head 4 at its end directed towards the opening 2 of the tuyere. The nozzle orifices in said nozzle head 4 are arranged in the radial direction of the lance 3 in such a manner that the oil is injected with a substantial radial component into the blast air 5 which has a temperature of between 900° or 1000° C. and 1200° or 1400° C., respectively.

The inner diameter of the lance 3 and the nozzle orifices of the nozzle head 4 are dimensioned such that, at a given supply pressure of the oil fed into the oil lance 3, the oil emerges from the nozzle head in the form of initially closed (non-atomized) oil jets 6, whereby it advances in the form of these jets to a position closely adjacent the inner wall of the blast tuyere 1 where it is atomized into an oil spray 7 or cloud of fine droplets which are then rapidly burned within the hot blast air 5. The injection of the oil must be effected in such a manner that the oil spray is still sufficiently spaced, e.g. by 1 centimeter, from the inner wall of the blast tuyere 1 since, when the oil strikes the inner wall of the blast tuyere 1, there would be formed deposits of cracked oil and soot on this inner wall, which deposits on the one hand could affect the flow of the blast air 5 and on the other hand would disturb the uniformity of the cooling of the blast tuyere 1 such that the latter could suffer from damage.

The uniformity of the spacing 8 (or distance) from the inner wall of the blast tuyere greatly depends on variations in the volume of the blast air 5 at a given constant supply pressure of the oil.

In order that the spacing 8 from the inner wall of the blast tuyere 1 is always maintained sufficiently constant, according to FIG. 1 a separate control device is provided for each individual blast tuyere. To this end, at first the quantity of the blast air is continually measured by means of an air volume measuring instrument 11 (which may be formed e.g. as a differential pressure measuring device), and the pulse $\Delta P$ resulting from this measurement is converted into a differential voltage ($\Delta U$) in a transducer 12 into a differential current ($\Delta J$) in another transducer 13, which current controls a ratio controller 21. The ratio controller 21, in turn, activates a servomotor 14 on a shaft 15 on which there are arranged in combination two valves, namely a water valve 16 controlling the water supply 17, and an oil valve 18 which regulates the fuel oil supply 19. Both valves are connected to a common conduit 20 which in turn is connected to the oil lance 3.

The ratio controller 21 controls the addition of the fuel oil in such a way that the injection velocity of the oil at the orifices of the nozzle head 4, at an air velocity of about 200 meters per second (m/sec), is from about 20 to 25 m/sec, i.e. 1/10 of the blast air velocity, for example.

For safety reasons, the position of the servomotor 14 is followed up (fed back) by a remote indicator sensing or detector device 23 which through a remote indicator transducer 22 renders possible a set point/actual point comparison 24 within the ratio controller.

By means of a control device 10 constructed in the manner as described above, the method can be carried out with optimum sensitivity, whereby in view of the sensitivity of the mode of operation of the blast tuyeres 1 of a blast furnace, each individual blast tuyere 1 must be equipped with such a control device.

In the design of the control device, it has to be taken into account that the differential pressure is proportional to the square of the volume of blast air. The servomotor 14 may control essentially the injection pressure, while the ratio controller 21 regulates the ratio of the oil volume injected relative to the respective volume of the blast air flowing through the blast tuyere 1. In the start-up of the operation of a blast furnace, there is first performed a general manual program presetting, and that both for the whole system and, if necessary, also for each blast tuyere 1 separately. As the valves 16 and 18 in the example shown are coupled with each other on the rigid shaft 15, the ratio existing between both valves in every position of the servomotor 14 is constant, too.

On the basis of the full rated operation, the injection of the oil is initially performed in a way as illustrated in connection with the blast tuyere 1 shown in FIG. 1. When the air volume meter 11 measures a drop in the volume of the blast air, the position of the shaft 15 is varied through the control device 10 and the servomotor 14 in a manner to slightly close the oil valve 18 such that the oil jets 6 cannot strike the inner wall of the blast tuyere 1 because of their lesser deflection at a lower volume of the blast air. In the case of a further drop of the air volume, first the oil pressure is further reduced such that the pattern of the oil jets 6 as shown in FIG. 1 is maintained and optimum combustion is ensured.

Preferably, the servomotor 14 is set to a fixed or determined maximum setting so that the oil pressure cannot anymore rise analogously if a rated air volume determined for normal operation is exceeded, because this could result in an overproportioning of the ratios at the mouth of a blast tuyere which for any reason whatsoever accepts a greater volume of the blast air than normally contemplated for an individual blast tuyere. Lacking the abovementioned limitation, the blast furnace could operate outside of its operational limits. Besides, a proportional increase of the oil volume along with a more-than-normal volume of the blast air would result in the formation of very coarse droplets of the oil spray 7 which would lead to a deterioration of the replacement-ratio of the oil for coke.

Figure 2:
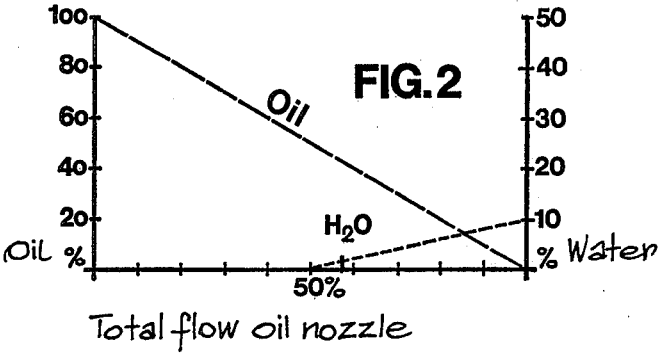
FIG. 2 is a diagram showing the effects of the device according to the invention.
Figure 3:
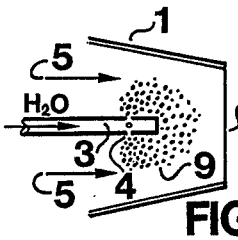
FIG. 3 is a schematical view of the blast tuyere of a blast furnace, which blast tuyere is cooled with water in accordance with the invention.
Figure 4:
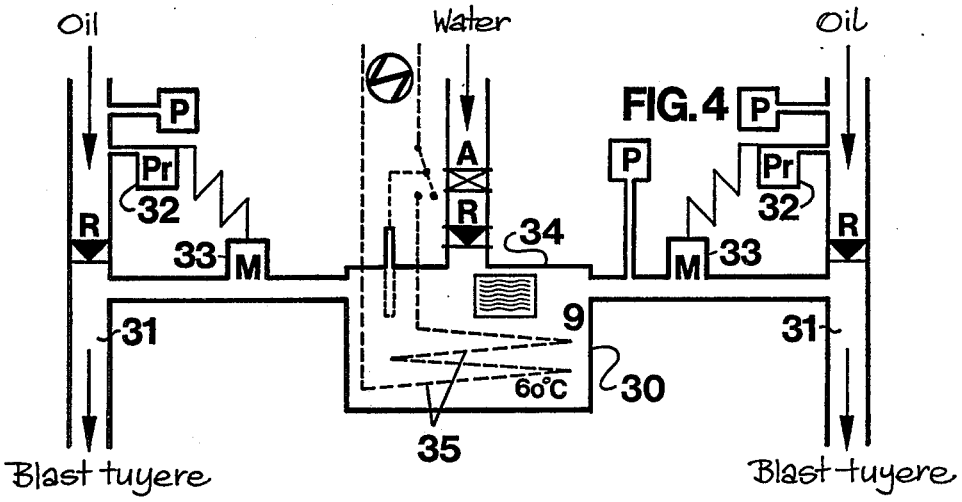
FIG. 4 is a schematical view of a modified embodiment of the apparatus according to the invention.

When the volume of the blast air drops to such a degree that the volume of the oil is reduced to below a value of between 40% and 60%, preferably about 50% of the full rating (corresponding e.g. to a volume of oil injection of 120, 150, 180 or 200 kilograms of oil per (metric) ton of pig iron), a further reduction of the volume of the oil would no longer allow a sufficient cooling of the lance 3 to be effected. Accordingly, (as shown in FIG. 2) beginning with a value of about 50% of the rated oil volume a coolant 9, namely water, will be added to the oil, which coolant addition is performed in that the servomotor 14 below a position corresponding to an oil volume of 50% increasingly opens the water valve 16. This water added to the oil then serves to effect an auxiliary cooling of the lance 3. Thus, with an increasingly further adjustment of the servomotor 14, the oil volume is reduced and the water volume is constantly increased to such a degree that this water volume, at zero oil volume, amounts to a maximum of 10%, preferably also 5% of the original full rated oil volume. This slight water flow through the lance 3, with substantially stationary blast air flow, is sufficient to adequately protect the lance against destruction. As shown in FIG. 3, the cooling water then emerges from the nozzle orifices of the nozzle head 4 in the form of a steam spray mist. In the modified embodiment of the control device 30 according to the invention as shown in FIG. 4, the coolant 9 is supplied from a common coolant reservoir 34 via the oil supplies 31 to the oil lances in response to pressure signals 32 and magnet or solenoid valves 33. Hereby, the water pressure must constantly be above the oil pressure. In view of the fact that the oil becomes flowable only at a temperature of above 40° C., the coolant must be heated to a temperature of at least 60° C. by means of a heater 35 in order that the fuel oil, when supplied at a temperature of above 100° C., does not fall below its setting or pour point so as to clog the system.

What I claim is:

1. An apparatus for controlling the injection of oil into a blast furnace through at least one oil nozzle in a blast tuyere, the apparatus comprising:

a measuring means for measuring the flow of blast air and adapted to be positioned in the conduit of the blast tuyere;

a ratio controller means connected to the blast air flow measuring means for controlling the ratio of oil volume to blast air volume;

a common connection means;

a water valve and an oil valve connected to the common connection means, both valves connected to a common conduit which is adapted to be connected to the oil nozzle;

a servo means connecting the ratio controller means to the common connection means and controlling the opening and closing of the water valve and the oil valve in proportion to one another.

2. The apparatus as claimed in claim 1, wherein the connection between the blast air flow measuring means and the ratio controller means comprises:

a first transducer connected to the blast air flow measuring means for converting a differential pressure from the flow measuring means into a differential voltage; and a second transducer connecting the first transducer to the ratio controller means and converting the differential voltage into a differential current which controls the ratio controller means.

3. The apparatus as claimed in claim 1, further comprising a set value/actual value comparison which feeds back the servo means and the ratio controller means to each other.

4. The apparatus as claimed in claim 1, wherein the servo means is set to start the opening of the water valve when the oil volume is about 50 volume % of the oil volume at the full rated volume of the blast air.

5. The apparatus as claimed in claim 1, wherein the servo means is set to start the opening of the water valve when the oil volume is about 40 to 60 volume % of the oil volume at the full rated volume of the blast air.

* * * * *

UNITED STATES PATENT AND TRADEMARK OFFICE

CERTIFICATE OF CORRECTION

PATENT NO. : 4,127,259

DATED : November 28, 1978

INVENTOR(S) : FRIEDRICH AUGUST KARL LUTH

It is certified that error appears in the above-identified patent and that said Letters Patent are hereby corrected as shown below:

Column 3, line 51, "50%" (first occurrence) should read -- 60% --.

Signed and Sealed this

*Eighth* Day of *January 1980*

[SEAL]

*Attest:*

SIDNEY A. DIAMOND

*Attesting Officer*

*Commissioner of Patents and Trademarks*